US006378139B1

(12) United States Patent
Mazzaglia

(10) Patent No.: US 6,378,139 B1
(45) Date of Patent: Apr. 30, 2002

(54) LOUNGING AND SLEEPING STOCKING

(76) Inventor: Patricia A. Mazzaglia, 4606 Mill Village Rd., Raleigh, NC (US) 27612

( * ) Notice: Subject to any disclaimer, the term of this patent is extended or adjusted under 35 U.S.C. 154(b) by 0 days.

(21) Appl. No.: 09/840,686

(22) Filed: Apr. 23, 2001

Related U.S. Application Data

(63) Continuation-in-part of application No. 09/280,741, filed on Mar. 29, 1999, now abandoned
(60) Provisional application No. 60/080,754, filed on Apr. 6, 1998.

(51) Int. Cl.[7] ..... A41B 11/12
(52) U.S. Cl. ..... 2/242
(58) Field of Search ..... 2/242, 239, 240, 2/241, 409

(56) References Cited

U.S. PATENT DOCUMENTS

| | | | | | |
|---|---|---|---|---|---|
| 340,132 | A | * | 4/1886 | Loesner | |
| 1,644,185 | A | * | 10/1927 | Fischer | |
| 1,823,736 | A | * | 9/1931 | Goodman | |
| 2,918,679 | A | * | 12/1959 | Bell | 2/240 |
| 3,800,331 | A | * | 4/1974 | Taddeo | 2/240 |
| 3,856,008 | A | * | 12/1974 | Fowler et al. | 128/165 |
| 3,874,001 | A | * | 4/1975 | Patience et al. | 2/240 |
| 4,172,456 | A | * | 10/1979 | Zens | 128/165 |
| 4,424,596 | A | * | 1/1984 | Jackson | 2/240 |
| 4,599,812 | A | * | 7/1986 | Harmsen | 36/1.5 |
| D300,086 | S | * | 3/1989 | Gaither | D2/331 |
| 5,345,613 | A | * | 9/1994 | Jones | 2/240 |
| 5,497,513 | A | * | 3/1996 | Arabeyre et al. | 2/240 |
| 5,566,396 | A | * | 10/1996 | Leib | 2/239 |
| D375,196 | S | * | 11/1996 | Kluttz et al. | D2/993 |
| D377,265 | S | * | 1/1997 | Lindaman | D2/993 |
| 5,737,776 | A | * | 4/1998 | Jennings | 2/409 |
| 6,135,974 | A | * | 10/2000 | Matz | 602/62 |

* cited by examiner

*Primary Examiner*—John J. Calvert
*Assistant Examiner*—Alissa L. Hoey
(74) *Attorney, Agent, or Firm*—Mills Law Firm PLLC

(57) ABSTRACT

A lounging and sleeping stocking includes a stocking body having a loose fit with the leg and foot of a user to provide a warm, loose fitting. Infinitely adjustable closure is provided at the upper end of the stocking to allow the stocking to be lightly secure for walking short distances and to prevent warm air from escaping while not being so tight as to reduce the circulation of blood to the legs and feet of the user. An anti-slip sole is provided for preventing the use from slipping and possibly falling on uncarpeted, smooth surfaces.

5 Claims, 5 Drawing Sheets

LOUNGING AND SLEEPING STOCKING

RELATED APPLICATIONS

This application is a continuation-in-part application of U.S. Ser. No. 09/280,741 filed on Mar. 29, 1990 now abandoned in the name of Patricia A. Mazzaglia and entitled "Lounging and Sleeping Garment" and claims benefit under 35 USC 119 of U.S. Provisional Application 60/080,754 filed on Apr. 6, 1998 in the name of Patricia A. Mazzaglia and entitled "Tubular Stocking with Drawstring".

FIELD OF THE INVENTION

The present invention relates to hosiery and, in particular, to a tubular stocking for maintaining leg comfort while lounging and sleeping.

BACKGROUND OF THE INVENTION

When lounging and sleeping, the feet and legs of the person quite often get cold. Put another way, if the feet and legs of a person are warm, the remainder of the body tends to be warm.

Keeping the feet and legs warm during lounging and sleeping is an age-old problem. If the person wears socks or stockings that are designed to be worn during normal daily activities, which must be tight enough not to slide down the leg and crumple into the shoe, they are too tight and reduce blood circulation in the legs and feet during resting and sleeping. Any reduction in the circulation to the lower extremities will make the legs and feet colder. This, of course, accomplishes the opposite effect from that desired, i.e. making the legs and feet colder rather than warmer.

Various types of stockings and leggings have been developed, thigh high for stockings and knee high for leggings.

Ladies stockings historically have been designed to go over the knee to the upper thigh, but these invariably fit skin tight even if they are held up by a garter belt. Stockings are also usually made from thin knit fabric.

Stockings as described above are not suitable for lounging and sleeping since they are firstly, tight fitting which can reduce circulation and secondly, the fabric that fits skintight does not retain heat very well.

For instance, U.S. Pat. No. 340,131 to Loesner et al. discloses a ladies stocking with a gusset at the knee with bands and buckles to adjust enough tension to hold the stocking in place.

U.S. Pat. No. 147,385 to Gernshym discloses leggings having a stirrup foot and a drawstring for holding the legging in place.

U.S. Pat. No. 1,644,185 to Fischer discloses a gartered hosiery using buttons to hold the hosiery in place.

U.S. Pat. No. 2,700,161 to Boyce discloses a gauntlet sock with a split cuff for holding the sock in place.

U.S. Pat. No. 1,823,736 to Goodman discloses hosiery with a pull-tab at the top of the tube portion with support member passing therethrough, which are tied to hold the hosiery in place.

U.S. Pat. No. 5,566,396 to Leib discloses a stocking construction using tapered knit leg with a drawstring in the upper cuff.

In view of the foregoing, it would be desirable to provide a lounging stocking having a loose fit about the wears leg area and being held in place with sufficient elasticity for sleeping and lounging activities while being adjustable to provide sufficient elasticity for retaining position during walking and other non-lounging activities.

SUMMARY OF THE INVENTION

The foregoing objects are accomplished by lounging and sleeping sticking that is warm, loose fitting and covers the feet and legs of the user to the upper thigh. To prevent the stocking of the present invention from falling down when the user arises from either lounging or sleeping, an infinitely adjustable means at the top open end of the stocking is provided so that just the slightest pressure can be exerted on the leg sufficient for holding the stocking in place for short walking distances. The pressure is insufficient to affect or reduce the circulation in the legs and feet of the user and may be adjusted to individual needs.

Tie strings, hook and loop fasteners, slip lock buckles and the like can be used for adjusting the retaining pressure. High friction coefficient soles are applied to the bottom of the foot portion to prevent the user from slipping and possible falling when walking on non-carpeted areas such as wooden floors, tile floors and the like. The stocking may be made from natural or man-made fibers that are warm and comfortable for lounging and sleeping.

In view of the above, it is an object of the present invention to provide a lounging and sleeping garment that is warm, loose fitting and covers the feet and legs of the user to the upper thighs.

Another object of the invention is to provide a lounging and sleeping stocking that includes and infinitely adjustable means by the top or open end of such stocking to provide slight pressure on the leg to hold the stocking in place while walking short distances.

A further object is to provide a lounging and sleeping stocking with adjustable fasteners for holding the stocking in place while walking short distances while not applying enough pressure to effect or reduce circulation in the legs and feet of the user.

Still another object is to provide a lounging and sleeping stocking having a tie string for lightly holding the stocking in place.

Yet another object is to provide a loose fitting stocking having high friction coefficient bottom surface for preventing slipping during walking.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
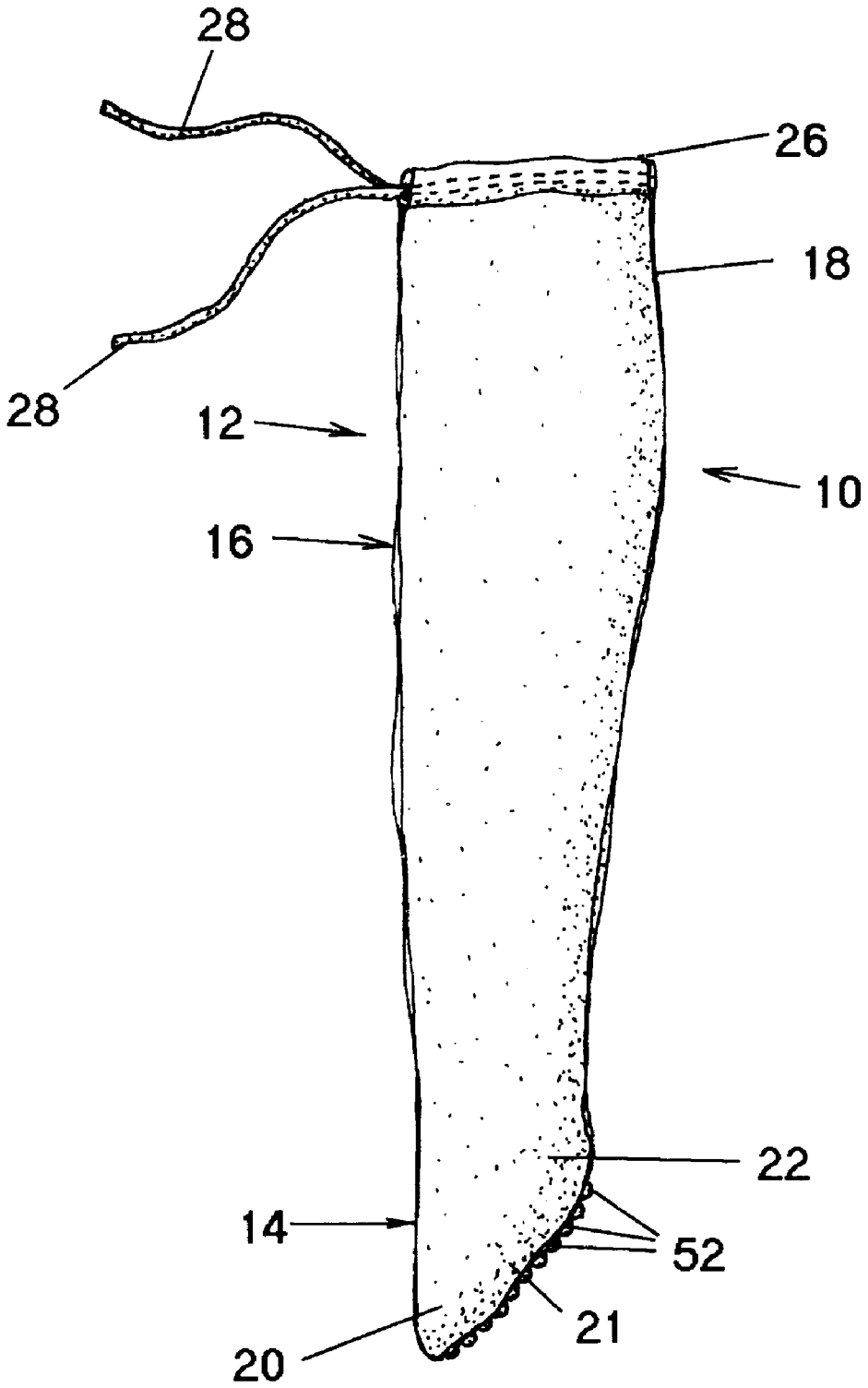
FIG. 1 is side elevational view of the lounging and sleeping stocking of the present invention in accordance with an embodiment of the invention having tie strings for maintaining the top end in place.

Referring to the drawings for the purpose of describing the preferred embodiment and not for limiting same, FIG. 1 illustrates a lounging and sleeping stocking 10 having a tubular stocking body 12 including a lower foot portion 14, an intermediate leg section 16, and an upper thigh section 17. The body 12 is formed of a single piece of knitted and/or elastic biased material, folded and the sides interconnected by a longitudinal stitched seam 18 extending from a toe section 20 on the foot section 14 to a sole section 21, a heel section 22 and upwardly along the leg section 16 terminating with an upper collar 26 at the thigh section 17. The upper collar 26 is reversely folded and stitched to define at upper open end an enclosed pocket carrying a tie string 28. The stocking body 12 thus defines an upwardly opening tubular sleeve for accordingly receiving the foot and leg of a wearer in the foot section 14 and the leg section 16, respectively, with retention at the upper thigh of the wearer at the collar 26. The circumference of the body 12 along the seam 18 is greater than the juxtaposed body part of the wearer such that the body along its length is loose fitting and non-conformal to wearer. The clearance is such that a single stocking size, or a limited number of sizes, will accommodate substantially the needs of the prospective users.

The length of the seam 18 is sufficient to position the collar 26 at the mid to upper thigh of a wearer. In use, the circumference of the collar 26 will provide a clearance or light compressive fit with the thigh of the wearer to nominally retain the stocking in position during limited movement activities, such as lounging or sleeping, without deleteriously exerting a pressure that would interfere with normal circulation. Thus disposed, the stocking prevents drafts or loss of heat that have been encountered in prior constructions using flaps and buttons for closure.

Figure 3:
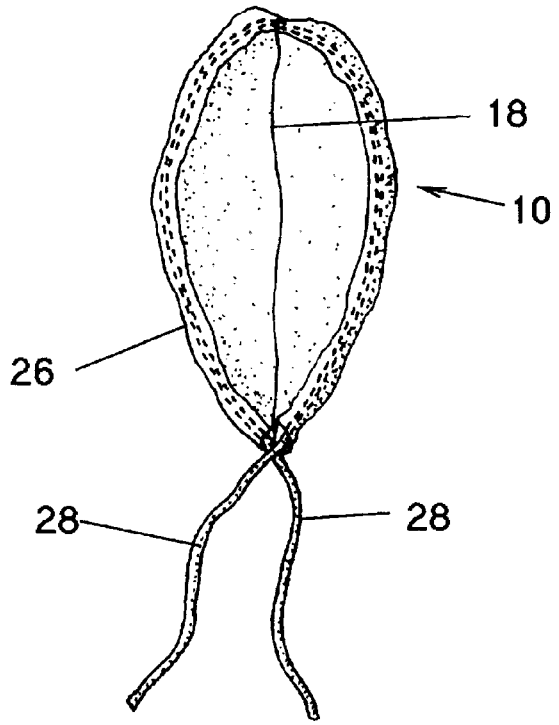
FIG. 3 is a top view of the stocking of FIG. 1.

Referring additionally to FIG. 3, the draw or tie string 28 exits the circumferential pocket in the collar 26 in a conventional fashion through slits at the front thereof. When the wearer undertakes increased activity and requires greater stocking retention at the thigh, the tie string 28 is tied in a conventional manner, thereby providing a stable stocking position during walking and similar pursuits.

Figure 2:
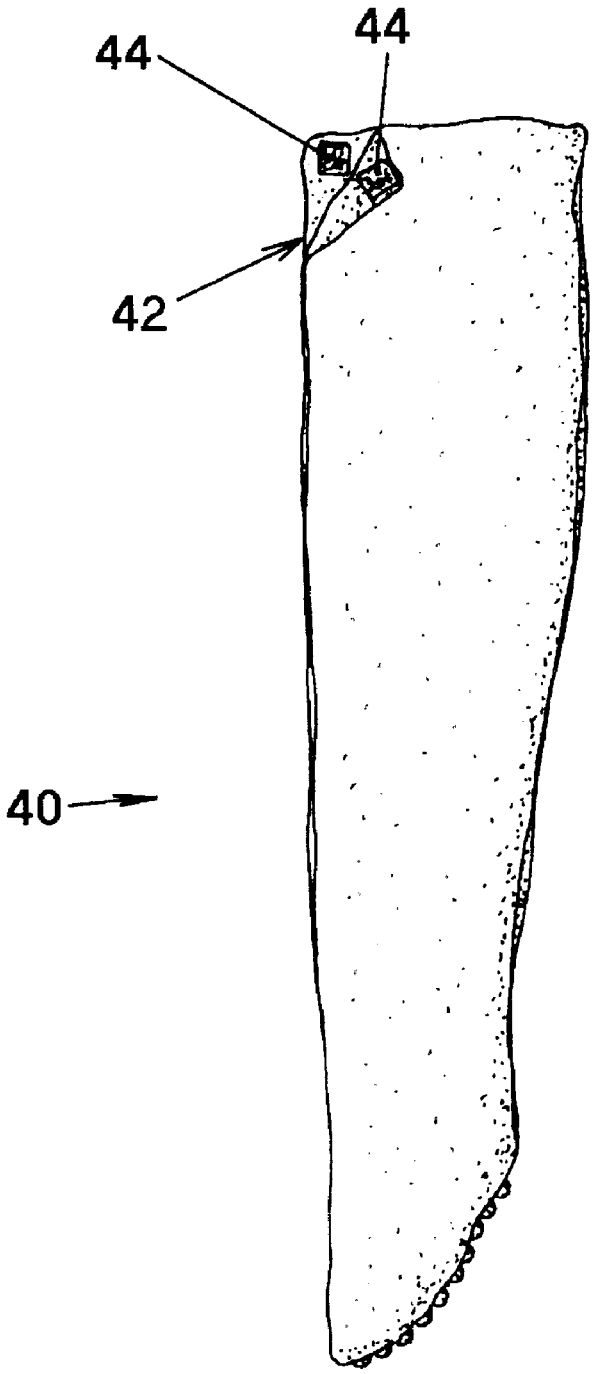
FIG. 2 is a side elevational view of the lounging and sleeping stocking in accordance with another embodiment of the invention having hook and loop fasteners for maintaining the top end in place.

Referring to FIG. 2, as an alternative to the drawstring closure of FIG. 1, the stocking 40 may be provided with an upper flap 42 at the top frontal end. Hook and loop closure pads 44 are disposed on the inner surface of one flap section and on the outer surface of the other flap section. Accordingly, to tighten the stocking 40, the flap sections are overlapped and contracted, and the closure pads 44 engaged to apply the desired tension against the thigh to maintain position during walking.

Figure 4:
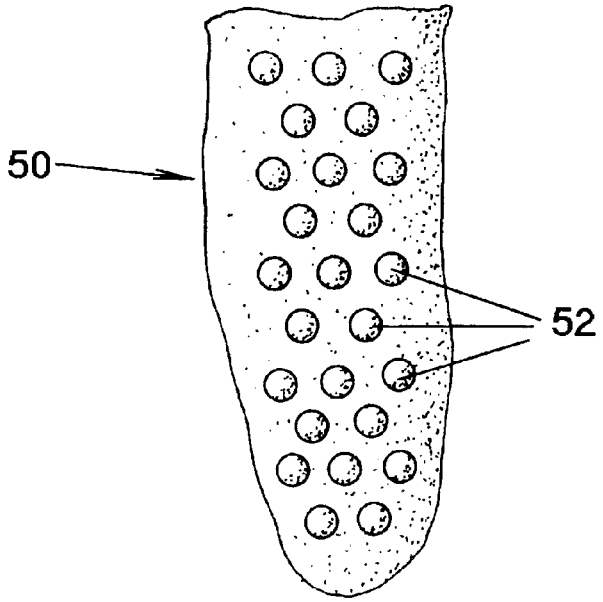
FIG. 4 is a fragmentary bottom view of the stocking of FIG. 1 illustrating the slip-resistant soles.
Figure 5:
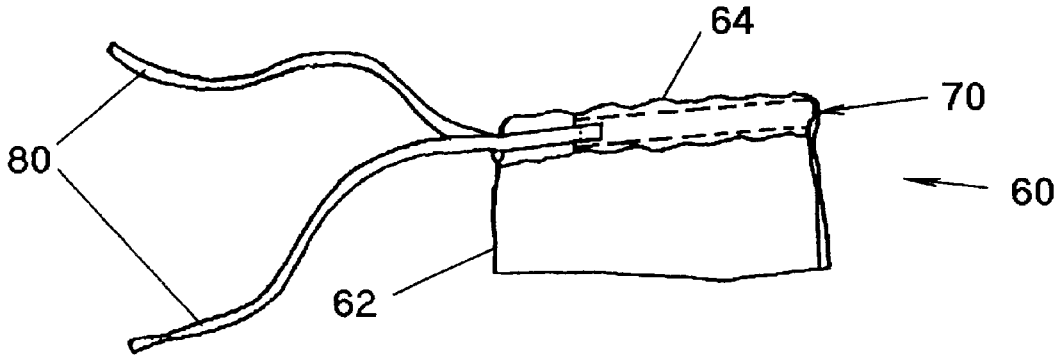
FIG. 5 is a side elevational view of the lounging and sleeping stocking in accordance with a further embodiment of the invention having an elastic band and tie string for maintaining the upper end in place.
Figure 6:
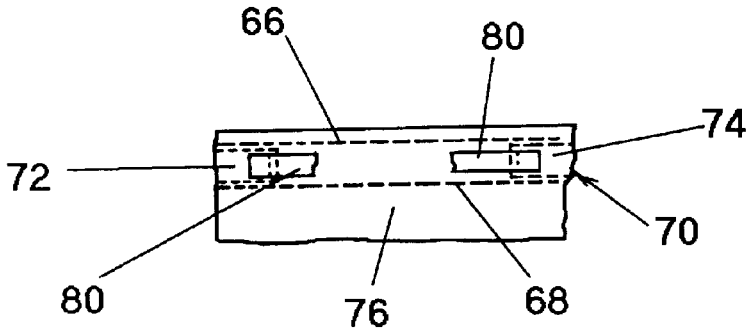
FIG. 6 is a fragmentary front view of the upper end of the stocking of FIG. 5.

Referring to FIG. 4, the foot section 14 of the stocking 10 is provided is provided with a non-skid surface 50 in the form of an array of high-friction elastomeric pads 52, or like slip resistant material.

Referring to FIGS. 5 through 8, there is shown another embodiment of a lounging stocking 60 differing from the prior embodiments with regard to the closure system for maintaining the upper end of the stocking in place during both modes of activity. Therein, the stocking body 62 is reversely folded and stitched to form a circumferential pocket 64 at an upper seam 66 and a lower seam 68. An elastic band 70 is carried in the pocket 64 and has a length less than the free-form circumference with ends 72 and 74 symmetrically spaced on either side of the front center adjustment panel 76. The ends 72, 74 are stitched at seams 78 to secure the band 70 in place in the pocket 64. A pair of tie ribbons 80 have reversely folded ends 82 secured to the stocking pocket at the seams 76.

Figure 7:
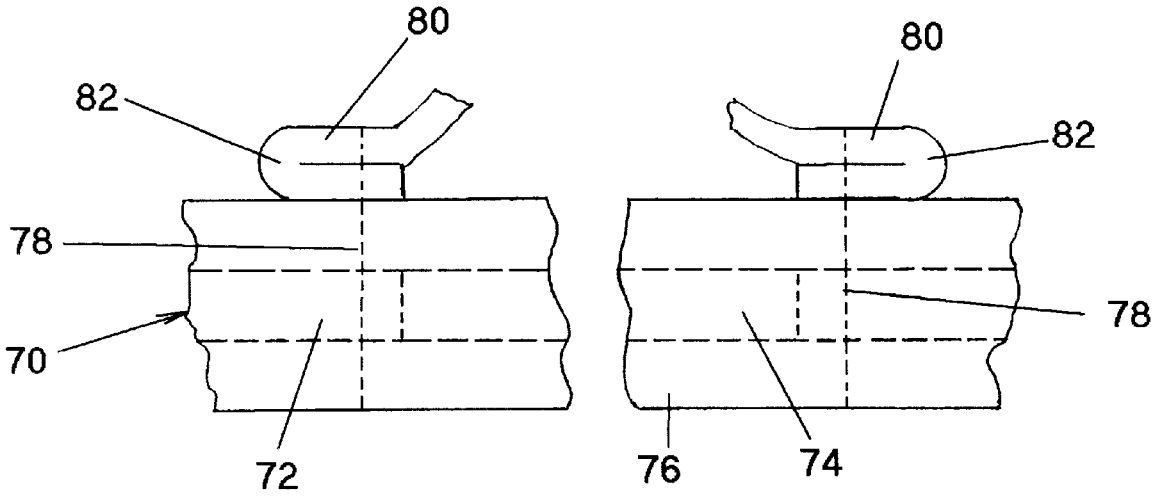
FIG. 7 is a fragmentary top view of the stocking of FIG. 5 in the lounging condition.
Figure 8:
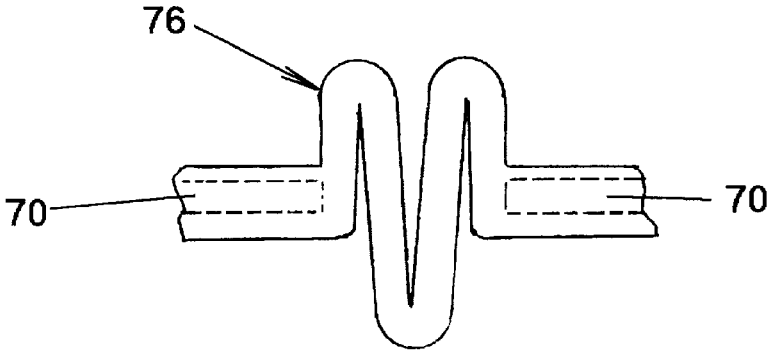
FIG. 8 is a fragmentary top view of the stocking of FIG. 5 in the tightened walking condition.

The stocking body 62 is formed of an elastic fabric with a free form upper opening slightly less than the upper thigh of the intended class of wearers. Accordingly, when the stocking 60 is pulled into position, the upper end expands against the biasing of the elastic band 70 thereby providing sufficient compressive force for maintaining the stocking in place during sleeping and lounging activities as shown in FIG. 7 with the panel 76 extended. As shown in FIG. 8, when wearer decides to engage in other activities, the tie ribbons 80 are looped and drawn tighter, thereby folding and foreshortening the center panel 76 and increasingly stretching the elastic band 70 for greater retention force. When sufficiently tight, the ribbons are tied in conventional fashion, and the wearer can engage in normal walking and other activities.

The stocking 80 thus provides dual positive modes of retention for maintaining continuous positioning under normal and lounging activities.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A lounging and sleeping stocking for covering the foot and leg of a wearer, comprising: a one-piece body member and a sole member, said body member having a vertical central fold line for positioning adjacent the front of the leg of the wearer and extending vertically from a lower toe section to an upper end for positioning at the thigh of the wearer, said fold line bounded by continuous abutting outer edges including an upwardly and outwardly extending foot section and heel section for positioning adjacent the lower edge of the sole of the wearer, and a pair of upwardly extending longitudinal edges extending from said heel section to said upper end for positioning adjacent the rear of the leg of the wearer; a first stitched seam joining said longitudinal edges, said sole member connected to said foot section and said heel section of said body member thereby forming a tubular member for receiving the foot and leg of the wearer, the tubular member being longitudinally sized to present a non-compressive engagement with the juxtaposed leg of the wearer insufficient to maintain position of said body member during walking movement by the wearer; the upper end of said body being reversely folded to form an upper collar; and a second stitched seam joining said upper collar to said upper end of said body; and closure means associated with said upper end of said body for contracting said upper collar sufficiently to maintain the position of said body member during walking movement by the wearer.

2. The lounging and sleeping stocking as recited in claim 1 wherein said collar defines a peripheral passage having adjacent open ends and said closure means includes a tie ribbon carried in said passage for tying by the wearer to reduce the size the upper end to provide a desired temporary compressive engagement with the leg of the user.

3. The lounging and sleeping stocking as recited in claim 1 wherein said closure means includes hook and loop fasteners.

4. The lounging and sleeping stocking as recited in claim 1 wherein the outer surface of said sole member is provided with a slip resistant surface.

5. The lounging and sleeping stocking as recited in claim 1 wherein an elastic band is connected partially circumferentially around said upper end, said elastic band having opposed band ends and defining therebetween a panel member, and tie ribbons connected to said opposed band ends whereby contracting said upper end and tying said ribbons compresses said panel member and narrows said upper end thereby providing increased retention of the stocking on the wearer.

* * * * *